United States Patent [19]

Gamble

[11] Patent Number: 4,576,022

[45] Date of Patent: Mar. 18, 1986

[54] OBJECT SECURING SLEEVE FOR PADLOCK DEVICES

[76] Inventor: William E. Gamble, P.O. Box 220598, Charlotte, N.C. 28222

[21] Appl. No.: 645,179

[22] Filed: Aug. 29, 1984

[51] Int. Cl.[4] ..... E05B 67/53

[52] U.S. Cl. ..... 70/55; 70/63; 70/417

[58] Field of Search ..... 70/55, 54, 56, 417, 70/63

[56] References Cited

U.S. PATENT DOCUMENTS 4,372,138 2/1983 De Forrest ..... 70/56

FOREIGN PATENT DOCUMENTS 400959 8/1924 Fed. Rep. of Germany ..... 70/55

1365684 9/1974 United Kingdom ..... 70/54

*Primary Examiner*—Robert L. Wolfe

*Attorney, Agent, or Firm*—Peter Y. Lee; Albert L. Free; Richard D. Weber

[57] ABSTRACT

A security device including a sleeve adapted to fit over the body portion of a padlock and provided with slots or apertures to permit closing or locking of the sleeve with the sleeve enveloping the padlock body. An internally accessible pocket is provided in one internal face of the sleeve to receive a key or other object to be secured. The presence of the padlock body in the sleeve prevents access to the pocket. A window may be provided in one of the sleeve walls to provide access to the padlock release mechanism such as a combination mechanism or keyhole.

8 Claims, 9 Drawing Figures

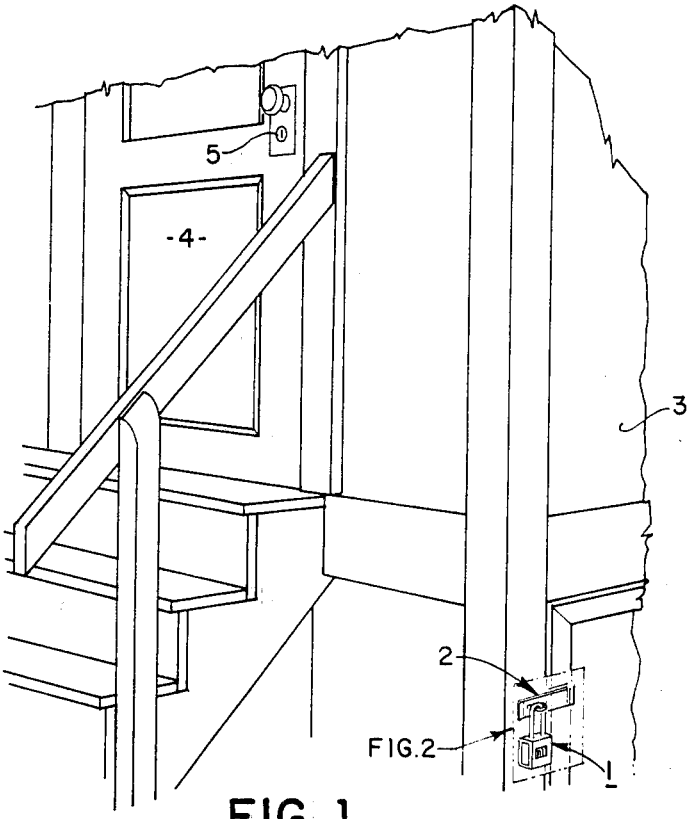
FIG. 1
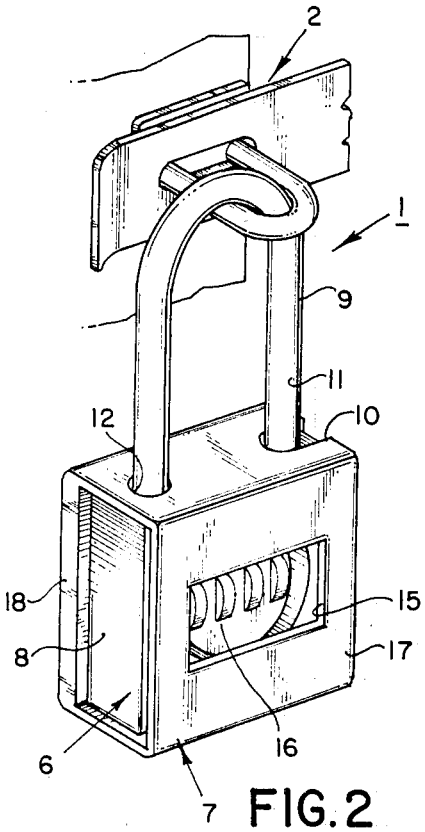
FIG. 2
FIG. 3
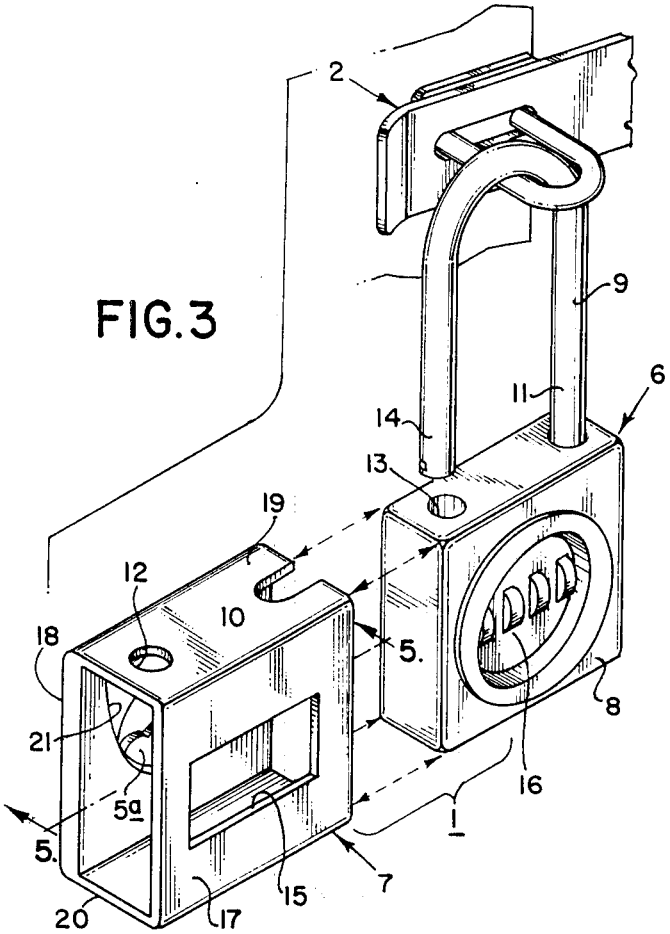
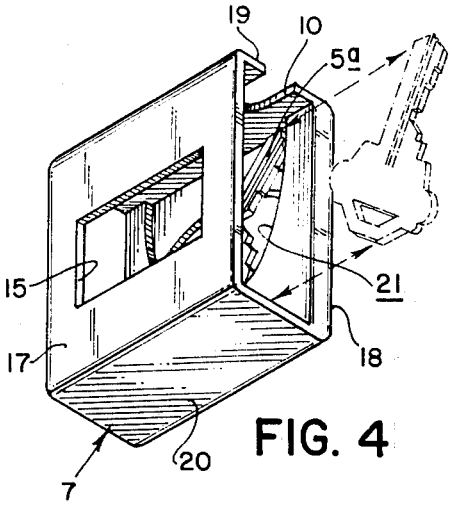
FIG. 4

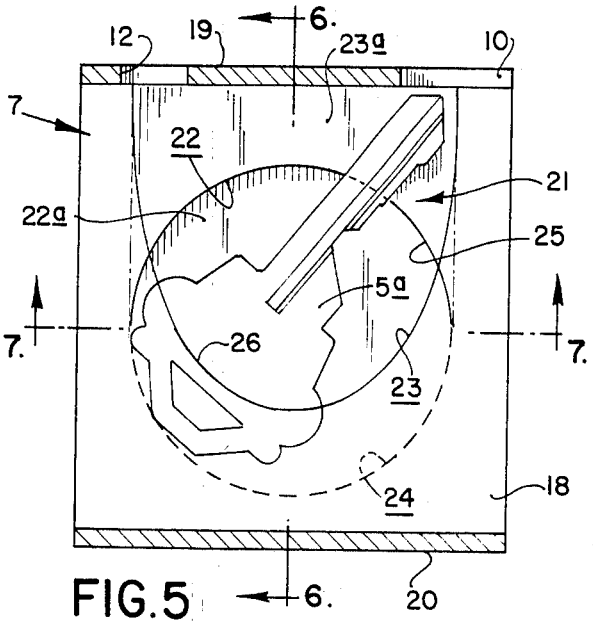
FIG.5
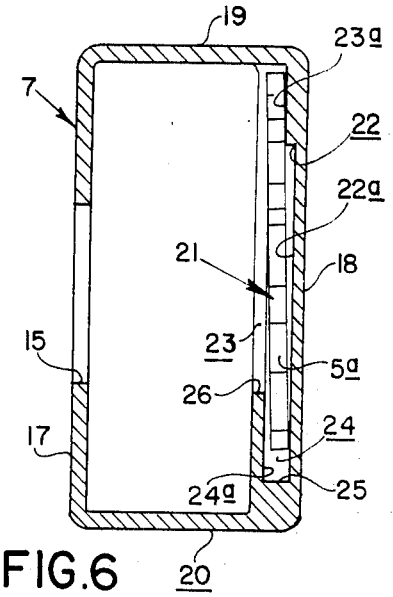
FIG.6
FIG. 7
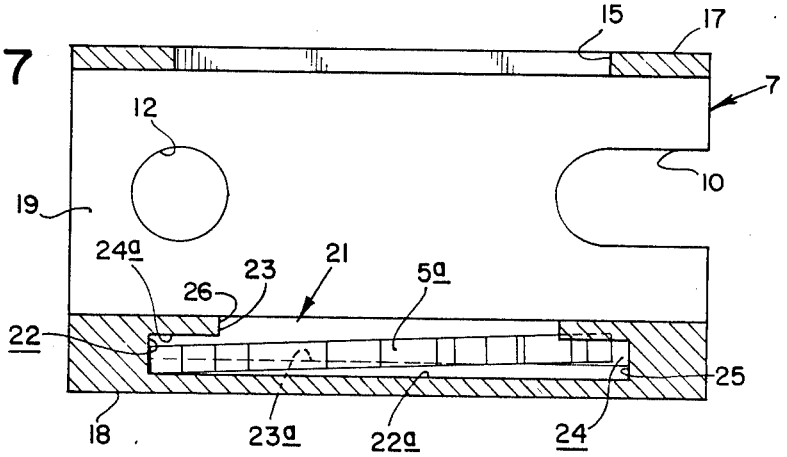
FIG.8
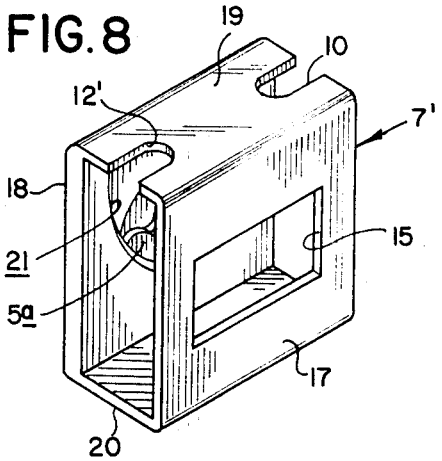
FIG.9
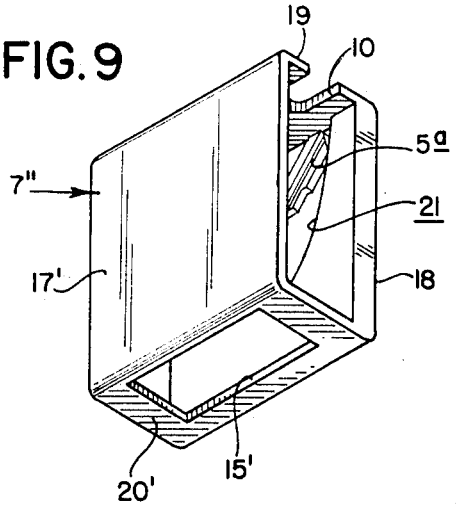

OBJECT SECURING SLEEVE FOR PADLOCK DEVICES

BACKGROUND OF THE INVENTION

The present invention relates generally to devices for securing small valuables to a fixed structure and relates more particularly to such a device which incorporates as a component thereof a conventional padlock.

In the business of selling houses and other properties, it is often necessary for a salesperson to gain access, at different times of the day, to a locked structure or enclosure such as a house, even though the salesperson is not able to conveniently obtain the key to the locked enclosure or, perhaps, is not allowed to keep the key for an extended period of time. For example, it may not be feasible to provide keys to a property to each of the realty agents having access to a cross referencing service, even though any one of these agents may, at a moment's notice, have a potential buyer desiring to see the property. Typically, the agent must waste considerable time to pick up the key for the selected property from the primary listing agent, and then return it to him after viewing the property with a client. It would save considerable time and expense if the key could be secured at the locus of the property in a way that permits authorized agents to gain access to the key, and thereby gain access to the property.

Specialty locks are known which can hold the key of the locked building within a specially constructed lock body. This type of lock is a complicated device having a locking mechanism designed around a cavernous portion wherein a key may be deposited. Although these specialty locks can be effective in locking a key or other small object, and hiding it from external view, their very complexity makes them relatively expensive and prone to failure, and hence, they have not been widely used.

SUMMARY OF THE INVENTION

The present invention provides a security device which has no integral locking mechanism, but which utilizes a conventional padlock to form a sturdy security device for securing a small object such as a key. The device comprises a sleeve having a pocket formed on an internal wall of the sleeve for holding and securing small objects. In a preferred embodiment, the internal pocket is formed on the inside back wall of the sleeve and is shaped to hold conventional keys. Insertion of a padlock body into the sleeve completely blocks external access to the contents of the pocket. Additionally, in the preferred embodiment, the object inside the pocket is completely hidden from view. The shank of the lock can be locked through two apertures in a top wall of the sleeve to rigidly affix the lock body to the sleeve, and can simultaneously be locked to a fixed structure such as a bracket or doorknob affixed to a house to thereby secure the keys from unauthorized persons.

It is accordingly a first object of the present invention to provide a device for the locking of a small object such as a key to a larger or fixed structure.

Another object of the invention is to provide a device as described which utilizes a conventional padlock as the locking means.

It is an additional object of the invention to provide a security sleeve as described which has a simple structure and which may be economically manufactured.

Still another object of the invention is to provide a device as described which may be constructed of a high impact plastic material.

The above and other objects and advantages of the invention will be more readily understood in view of the following description of preferred embodiments thereof.

BRIEF DESCRIPTION OF THE DRAWINGS

FIG. 1 is a perspective view of a security device embodying the invention shown in use adjacent to the corner of a house;

FIG. 2 is an enlarged view of the dot-dash portion of FIG. 1 showing details of the security device;

FIG. 3 is a perspective view of the device of FIG. 2, with the components thereof separated to show additional details;

FIG. 4 is a perspective view of the sleeve of the device shown in FIG. 3, additionally showing the placement of a key within a pocket inside the sleeve.

FIG. 5 is a front sectional view of the embodiment of FIG. 4;

FIG. 6 is a side elevational view taken along line 6—6 of FIG. 5;

FIG. 7 is an enlarged top sectional view taken along line 7—7 of FIG. 5;

FIG. 8 is a perspective view of the sleeve of another embodiment of the invention;

FIG. 9 is a perspective view of a sleeve of yet another embodiment of the invention.

DESCRIPTION OF THE PREFERRED EMBODIMENT

Referring to the drawings and, particularly, FIGS. 1 and 2 thereof, a security device 1 embodying the present invention is shown attached to a hasp 2 affixed to the side of a building 3, FIG. 1 shows an entrance to the building comprising a door 4 having a conventional lock 5. A key 5*a* for opening lock 5 is kept within security device 1 as shown in FIG. 4. The lock 5 and key 5*a* comprise a means for securing the building and a means for gaining access to the interior of the building.

Security device 1 comprises a conventional padlock 6 and a sleeve 7 which fits over body 8 of padlock 6. Padlock 6 has a U-shaped shank 9, including a shank base 11 and shank tip 14, which slides partially out of the padlock body 8. The padlock body 8 has a lock actuating and release mechanism including lock release tumblers 16. Padlock body 8 also contains a shank hole 13 for receiving shank tip 14 when the padlock is locked.

The sleeve 7 is dimensioned and shaped to fit snugly over padlock body 8 and comprises a front wall 17, rear wall 18, top wall 19, and bottom wall 20. Formed within the rear wall 18 is a pocket 21 which has sufficient space to hold a key 5*a* within it. A rectangularly shaped window 15 is located in the front wall 17. An aperture 12 and a slot 10 are provided on the left and right sides, respectively, of the top wall 19.

In the use of security device 1, the sleeve 7 can be easily slid over padlock body 8 with slot 10 of sleeve 7 aligned with the shank base 11. Padlock body 8 fits snugly within sleeve 7, with shank base 11 passing through slot 10, and with aperture 12 overlying shank hole 13, so that shank tip 14 may be inserted through aperture 12 and into shank hole 13 to actuate the lock mechanism inside padlock body 8.

Referring to FIGS. 5–7, pocket 21 includes a disc shaped cavity 22, access to which is gained through semi-oval shaped aperture 23. The bottom of cavity 22 is below the lower edge of aperture 23, thereby forming a recessed cavity portion 24. Pocket 21 thus comprises a circular surface 22*a*, abutting surface 23*a*, recessed portion surface 24*a*, circular rim surface 25 and semi-oval rim surface 26, all of which are formed in the interior or rear wall 18. The recessed portion 24, defined by recessed portion surface 24*a*, circular surface 22*a* and circular rim surface 25, prevents a key 5*a* in pocket 21 from falling out when padlock body 8 and sleeve 6 are joined in a locked configuration. The pocket 21 preferably has at least one recessed cavity portion 24, but may have more than one, and in other embodiments may not have any.

In using the security device 1, a key 5*a* is first placed within pocket 21, and sleeve 7 is slid over padlock body 8, as shown in FIG. 3. Sleeve 7 is dimensioned to fit closely over padlock body 8, so that access to pocket 21 is completely blocked by padlock body 8, and only authorized persons having the combination to the lock release tumblers 16 would be able to open padlock 6 and obtain the key 5*a* held within pocket 21 of sleeve 7.

Although a combination padlock 6 is shown in the preferred embodiment, other types of padlocks can be used, including mechanical key or magnetically actuated locks. The combination lock is preferred for use in the real estate business because the combination can be communicated to a sales agent by telephone. However, in some other uses for the security device 1, a plurality of key actuated padlocks may be employed, all of which may be actuable with the same master key, and an authorized person having this master key would be able to open a plurality of security devices 1, and gain access to a plurality of locked houses or the like.

The sleeve 7 may be constructed of a high impact plastic material, or a metallic or composite material using various methods which are well known.

Although the window 15 is shown in the above described embodiments as a rectangular window, it could, in fact, have any desired geometric shape, such as a circle or oval, depending on the type of lock actuating and release mechanism on the padlock to be used.

Referring to FIG. 8, another embodiment of this invention is shown wherein aperture 12 of sleeve 7 is replaced by a slot 12', similar to the slot 10 of the preferred embodiment of FIGS. 2–7. This second embodiment has the additional feature that a padlock can be slid into sleeve 7' from either the left or the right side of sleeve 7', and either slot 10 or slot 12' will accommodate shank base 11 or shank tip 14, respectively, of a padlock 6. In the embodiment of FIG. 8, if a padlock 6 is locked onto sleeve 7' with the lock release tumblers 16 facing the rear wall 18 instead of the front wall 17, there would be no access to the tumblers 16 through window 15, and it would no longer be possible to unlock the padlock 6 without first destroying sleeve 7'. This feature of the embodiment of FIG. 8 may not be desirable for the typical user of the security device who wishes to use sleeve 7' repeatedly, because if someone should mistakenly lock the device with the lock release mechanism 16 facing backwards, sleeve 7' would have to be destroyed to open the padlock.

Referring to FIG. 9, a third embodiment is shown wherein a window 15' is formed in the bottom wall 20' of sleeve 7''. This embodiment is used with any padlock which has a keyhole or combination dial, or other means for unlocking the padlock, on the bottom of the padlock body. Additionally, any padlock having a lock release mechanism, such as a key hole, on the left or right sides of the padlock body, can obviously be used with any of the embodiments shown in FIGS. 1–9, since these two sides of the sleeve are open. A window is obviously unnecessary in any sleeve wall for such type of lock.

I claim:

1. An object-securing sleeve means for use with a host padlock of the type having a shank member and a body portion, said sleeve means comprising front, rear, top and bottom walls and being open at least at one end and so sized as to permit sliding thereof into close-fitting covering relation to said padlock body portion when said padlock is open, said sleeve means containing object-retaining means accessible from within said sleeve means when said sleeve means is free of said body portion for releasably holding within it an object to be held secure when said sleeve means is on said body portion and said padlock is closed, said sleeve means also having locking aperture means in said top wall for permitting passage therethrough of said shank member to permit locking of said padlock and simultaneous locking of said sleeve means to said body portion, said sleeve means being so configured that when in locked position on said body portion said object cannot be removed from said object-retaining means, and wherein said sleeve means comprises window means for permitting sufficient access to said body portion to permit unlocking it while said sleeve means is in place.

2. The sleeve means of claim 1, wherein said object retaining means is so arranged that said object is invisible from the exterior of said sleeve means when said sleeve means and said object are mounted on said body portion.

3. The sleeve means of claim 1, wherein said object-retaining means comprises a pocket in a wall of said sleeve means.

4. The sleeve means of claim 3, wherein said pocket is configured to hold one or more keys.

5. The sleeve means of claim 4, wherein said pocket is configured to receive a single key in close-fitting relation.

6. The sleeve means of claim 1, wherein said locking aperture means comprises a locking aperture for receiving and substantially surrounding the movable free-end portion of said shank member, and a slot for partially surrounding the root-end portion of said shank member when said sleeve means is in its installed position on said body portion and permitting said root-end portion of said shank member to slide in and out of said slot as said sleeve member is installed on or removed from said body portion.

7. The sleeve means of claim 2, wherein said pocket is formed in said rear wall.

8. The sleeve means of claim 1, wherein said locking aperture means comprises a pair of slots in said top wall, the open ends of said slots facing oppositely to each other and said slots being aligned along a common axis.

* * * * *